United States Patent [19]

Lamle et al.

[11] Patent Number: 4,573,683

[45] Date of Patent: Mar. 4, 1986

[54] EDUCATIONAL PUZZLE CUBE

[76] Inventors: Stewart M. Lamle, 55 W. 86th St., New York, N.Y. 10024; Mark Setteducati, 218 E. 17th St., New York, N.Y. 10003

[21] Appl. No.: 677,094

[22] Filed: Nov. 30, 1984

Related U.S. Application Data

[63] Continuation-in-part of Ser. No. 553,494, Nov. 21, 1983, abandoned.

[51] Int. Cl.[4] ..... A63F 9/12

[52] U.S. Cl. ..... 273/157 R; 434/211

[58] Field of Search ..... 273/157 R, 156, 160; 434/211; 446/124

[56] References Cited

U.S. PATENT DOCUMENTS

| | | | |
|---|---|---|---|
| 907,203 | 12/1908 | Walker | 273/157 R |
| 1,565,099 | 12/1925 | Nierodka | 273/157 R |
| 4,317,654 | 3/1982 | Wahl | 434/211 |
| 4,334,870 | 6/1982 | Roane | 434/211 |
| 4,522,404 | 6/1985 | Di Gregorio | 273/157 R |

FOREIGN PATENT DOCUMENTS

| | | | |
|---|---|---|---|
| 2362648 | 4/1978 | France | 273/157 R |
| 396512 | 8/1933 | United Kingdom | 446/124 |
| 429509 | 5/1935 | United Kingdom | 273/157 R |

*Primary Examiner*—Anton O. Oechsle

*Attorney, Agent, or Firm*—Brian L. Ribando

[57] ABSTRACT

An amusement device comprises a solid cube which may be disassembled into a plurality of blocks of differing geometric shapes wherein each of the geometric shapes is formed from one or more modular units. Each modular unit comprises an isosceles right triangular prism having a triangular face formed by two legs each of which has a length A and which meet at a right angle, and a hypoteneuse which has a length B, said modular unit having a depth which is equal to A, and a volume which is equal to C. Each of the differing geometric shapes is formed from one or more modular units and has a volume equal to an integral number times C, and the total volume of said solid cube is equal to 16C.

7 Claims, 16 Drawing Figures

EDUCATIONAL PUZZLE CUBE

BACKGROUND OF THE INVENTION

This application is a continuation-in-part of U.S. patent application Ser. No. 553,494, filed Nov. 21, 1983, abandoned.

The present invention relates to sets of educational blocks having particular shapes and volumetric relationships which may be used for the visualization and manipulation of geometric relationships.

Sets of blocks having specific interrelationships are well known and have been described for educational and entertainment use. U.S. Pat. No. 4,317,654 to Whal shows a cube which is cut up to form particular polyhedra. The U.S. Pat. No. 3,208,162 to Wysdom describes a square root and cube root three-dimensional model. U.S. Pat. No. 595,782 describes a block model wherein a cube is divided into volumetric fractions such as one-third, two-thirds, and the like. U.S. Pat. 3,645,535 to Randolph describes various relationships between cubes, tetrahedrons and octohedrons as these shapes relate to a cubic block. Many puzzles have been devised in which a number of blocks or tiles are selected from a larger number of blocks or tiles and are used to create a construction. An example of this is described as a "Pentagonal Puzzle" by Calvert in U.S. Pat. No. 4,343,471.

SUMMARY OF THE INVENTION

This invention relates to a group or groups of blocks each of which is formed by combinations of one, two or four modular units consisting of isosceles right triangular prisms such that the depth of each prism equals the length of the legs of the isosceles right triangular plane of the prism. The volume of the constructed cube is 16 times the volume of the modular unit.

DESCRIPTION OF THE PREFERRED EMBODIMENT

Figure 1:
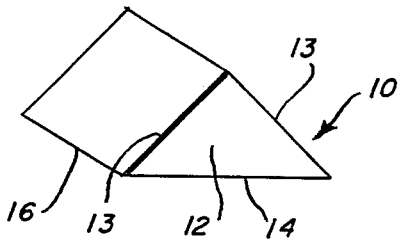
FIG. 1 shows the basic modular unit of the invention.

FIG. 1 shows a basic modular unit of the present invention generally designated by the reference numeral 10. The modular unit is an isosceles right triangular prism having a triangular face 12 formed by two equal length legs or sides 13 which meet at a 90° angle, and a hypotenuse 14. The depth of the prism measured along an edge 16 is equal to the length of either of the two isosceles legs 13. For the sake of simplicity throughout the specification, the length of each of the isosceles legs may be referred to as "A", and the length of the hypotenuse may be referred to as "B". The depth of the prism is therefore also equal to A, the area of the triangular face equals $\frac{1}{2}A^2$ and the volume of the prism equals $\frac{1}{2}A^3$. Again for simplicity, the volume $\frac{1}{2}A^3$ may be referred to as "C". The volume of the prism 10 or modular unit equals 1/16 the volume of the cube which may be constructed from the puzzle set. Accordingly, the volume of the cube equals 16C.

Figure 2:
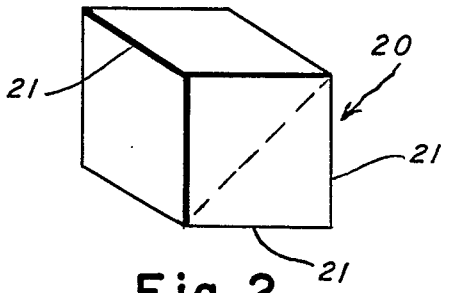
FIGS. 2 through 5 show blocks made from two of the modular units of FIG. 1.

Turning now to FIG. 2, a block 20 is shown which has the shape of a cube and is comprised of two of the modular units 10. The block 20 has sides 21 each of which has a length A. The volume of the block 20 is $A^3$ or 2C.

Figure 3:
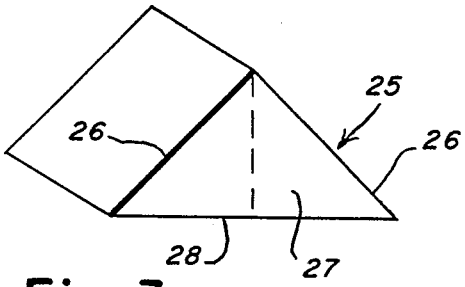

FIG. 3 shows a block 25 which has the shape of an isosceles right triangular prism and is comprised of two of the modular units 10. The block 25 has a triangular face 27 formed by two equal length legs 26 each having a length B which meet at a 90° angle, and a hypotenuse 28 which has a length 2A. The depth of the prism measured along the edge 29 is equal to A. The volume of the block 25 is $A^3$ or 2C.

Figure 4:
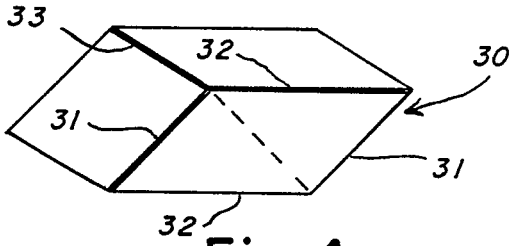

FIG. 4 shows a block 30 which has the shape of rhomboid prism. The block 30 is comprised of two of the modular units 10 and has two parallel edges 31 each having a length A and two parallel edges 32 each having a length B. The depth of the rhomboid prism measured along the edge 33 is A, and the volume of the rhomboid prism is $A^3$ or 2C.

Figure 5:
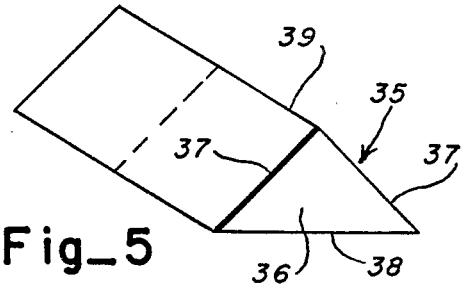

Referring now to FIG. 5, a block 36 is shown which has the shape of an isoseles right triangular prism comprising a triangular face 36 having two equal length sides 37 having a length A and a hypotenuse 38 having a length B. The depth of the prism 36 measured along edge 39 is 2A, and the volume of the prism 36 is $A^3$ or 2C.

Figure 6:
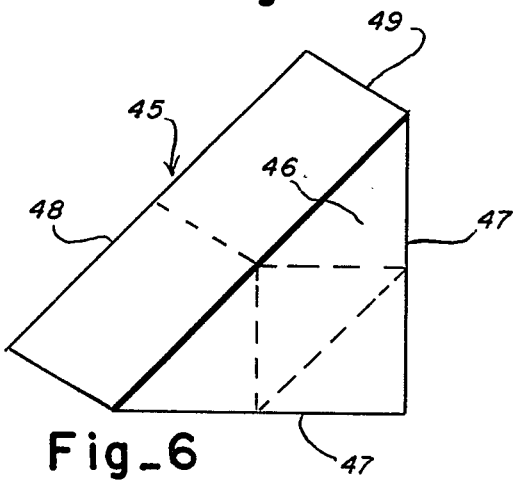
FIGS. 6 through 9 show blocks made from four of the modular units of FIG. 1.

Turning now to FIG. 6, a block 45 is shown which has the shape of an isosceles right triangular prism which is comprised of four of the modular units 10. The prism 45 has a triangular face 46 defined by two equal length sides 47 which meet at a right angle and each have a length 2A. The length of the hypotenuse 48 is equal to 2B, and the depth of the prism 45 measured along the edge 49 is A. The volume of the prism 45 is equal to $2A^3$ or 4C.

Figure 7:
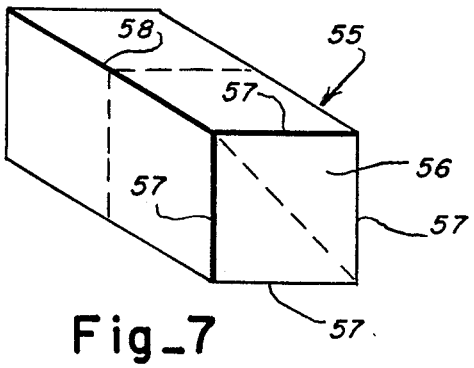

FIG. 7 shows a block 55 having the shape of a rectangular prism which comprises four of the modular units 10. The rectangular prism 55 comprises a square end face 56 having four sides 57 each with a length A. The depth of the prism 55 measured along edge 58 is 2A, and the volume of the prism 55 is equal to $2A^3$ or 4C.

Figure 8:
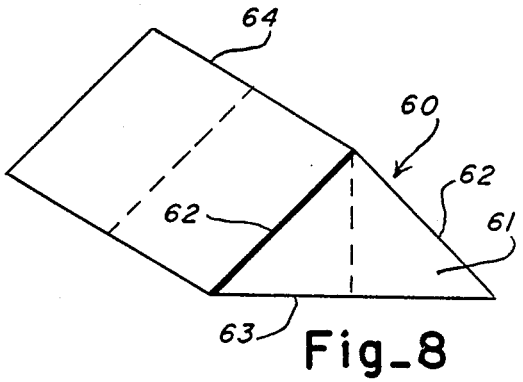

FIG. 8 shows a block 60 having the shape of an isosceles right triangular prism which comprises four of the modular units 10. The prism 60 comprises a triangular end face 61 having two equal length legs 62 which meet at a right angle and have a length B, and a hypotenuse 63 which has a length 2A. The depth of the prism 60 measured along edge 64 is 2A, and the volume of the prism 60 is $2A^3$ or 4C.

Figure 9:
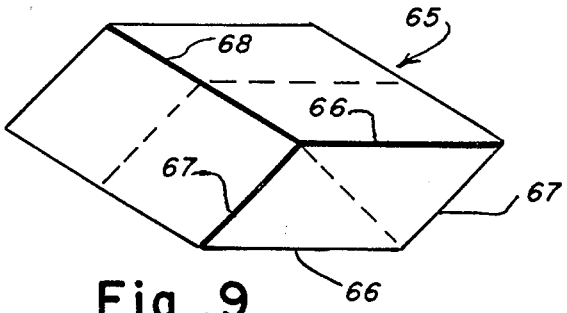

FIG. 9 shows a block 65 having the shape of a rhomboid prism comprised of four of the modular units 10. The prism 65 has two parallel edges 66 each having a length B and two parallel edges 67 each having a length A. The depth of the rhomboid prism 65 measured along edge 68 is equal to 2A, and the volume of the prism 65 is $2A^3$ or 4C.

A total of 16 modular units is required to make the puzzle cube. The 16 units may be selected from a combination of the blocks described in FIGS. 1 through 9. Each group which forms a constructed cube made of the required number of modular units is normally stored together as a constructed cube having a volume 16C. When the blocks are spread out, ingenuity and understanding are required to reassemble the blocks into the cube. Several embodiments of a cube constructed according to the invention are shown in FIGS. 10 through 16.

Figure 10:
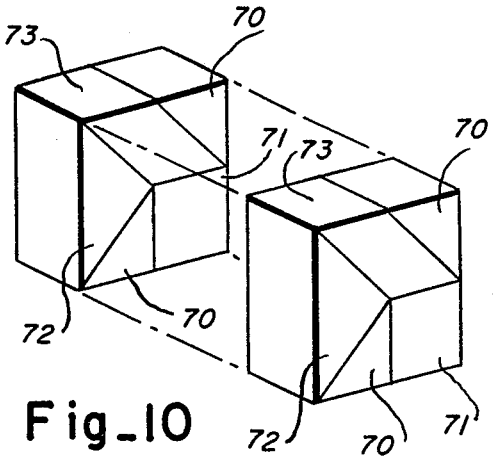
FIGS. 10 through 16 show various cube sets made in accordance with the present invention.

As shown in FIG. 10, a preferred combination for forming a cube consists of: 4 blocks 70 consisting of 1 modular unit each having the configuration of an isosceles right triangular prism with a depth equal to A as shown in FIG. 1, 2 blocks 71 each consisting of 2 modular units having the configuration of a cube with a depth equal to A as shown in FIG. 2, 2 blocks 72 each consisting of 2 modular units having the configuration of an isosceles right triangular prism with a depth equal to A as shown in FIG. 3, and 2 blocks 73 each consisting of 2 modular units having the configuration of a rhomboid prism with a depth equal A as shown in FIG. 4.

Figure 11:
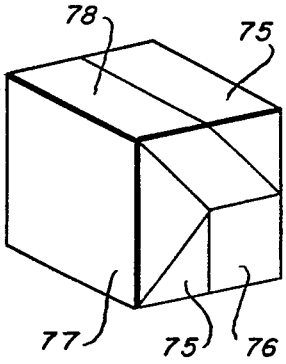

As shown in FIG. 11, other combinations of the blocks of FIGS. 1 through 9 may be used to form the puzzle cube. Another embodiment consists of: 2 blocks 75 each consisting of 2 modular units having the configuration of an isosceles right triangular prism with a depth equal to 2A as shown in FIG. 5, 1 block 76 consisting of 4 modular units having the configuration of a rectangular prism with a depth equal to 2A as shown in FIG. 7, 1 block 77 consisting of 4 modular units having the configuration of an isosceles right triangular prism with a depth equal to 2A as shown in FIG. 8, and 1 block 78 consisting of 4 modular units having the configuration of a rhomboid prism with a depth equal to 2A as shown in FIG. 9.

Figure 12:
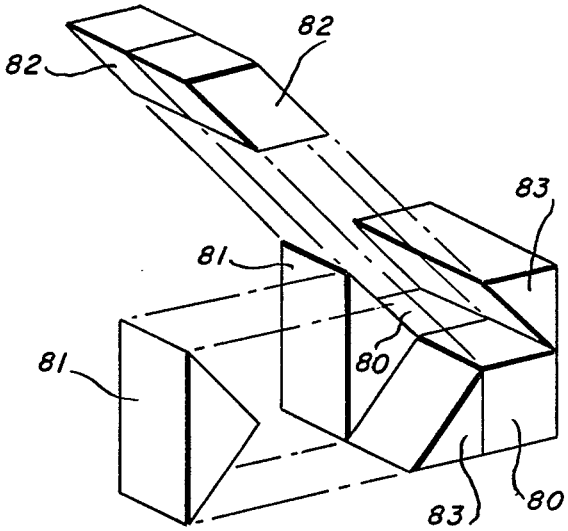

Turning now to FIG. 12, another construction of the puzzle cube is shown as comprising: 2 blocks 80 each consisting of 2 modular units having the configuration of a cube with a depth equal to A as shown in FIG. 2, 2 blocks 81 each consisting of 2 modular units having the configuration of an isosceles right triangular prism with a depth equal to A as shown in FIG. 3, 2 blocks 82 each consisting of 2 modular units having the configuration of a rhomboid prism with a depth equal to A as shown in FIG. 4, and 2 blocks 83 each consisting of 2 modular units having the configuration of an isosceles right triangular prism having a depth equal to 2A as shown in FIG. 5.

Figure 13:
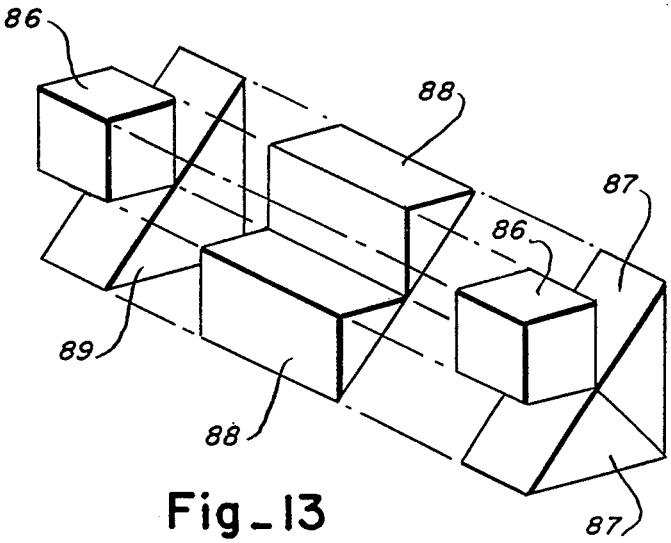

Turning now to FIG. 13, another construction of the puzzle cube is shown as comprising: two blocks 86 each consisting of two modular units having the configuration of a cube with a depth equal to A as shown in FIG. 2, two blocks 87 each consisting of two modular units having the configuration of an isosceles right triangular prism having a depth equal to A as shown in FIG. 3, two blocks 88 each consisting of two modular units having the configuration of an isosceles right triangular prism with a depth equal to 2A as shown in FIG. 5, and one block 89 consisting of four modular units having the configuration of an isosceles right triangular prism having a depth equal to A as shown in FIG. 6.

Figure 14:
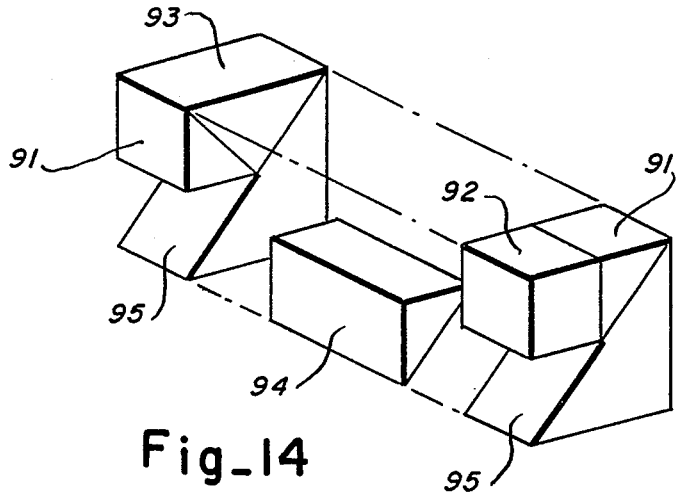

Referring now to FIG. 14, another construction of the puzzle cube is shown as comprising: two blocks 91 each consisting of one modular unit having the configuration of an isosceles right triangular prism with a depth equal to A as shown in FIG. 1, one block 92 consisting of two modular units each having the configuration of a cube as shown in FIG. 2, one block 93 consisting of two modular units having the configuration of an isosceles right triangular prism with a depth equal to A as shown in FIG. 3, one block 94 consisting of two modular units having the configuration of an isosceles right triangular prism having a depth 2A as shown in FIG. 5, and two blocks 95 each consisting of four modular units and having the configuration of an isosceles right triangular prism with a depth equal to A as shown in FIG. 6.

Figure 15:
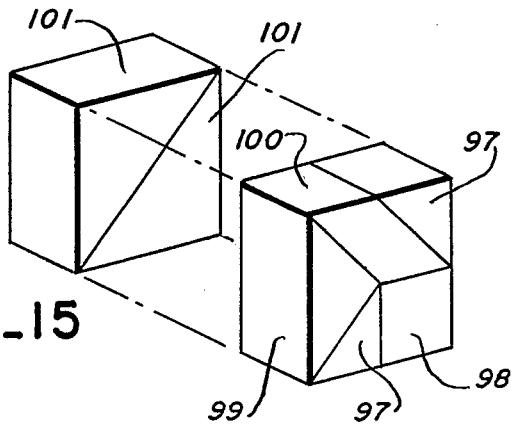

Referring now to FIG. 15, another construction of the puzzle cube is shown as comprising: two blocks 97 each consisting of one modular unit having the configuration of an isosceles right triangular prism with a depth A as shown in FIG. 1, one block 98 consisting of two modular units having the configuration of a cube with a depth A as shown in FIG. 2, one block 99 consisting of two modular units and having the configuration of an isosceles right triangular prism with a depth A as shown in FIG. 3, one block 100 consisting of two modular units having the configuration of a rhomboid prism with a depth A as shown in FIG. 4, and two blocks 101 each comprising four modular units and having the configuration of an isosceles right triangular prism with a depth A as shown in FIG. 6.

Figure 16:
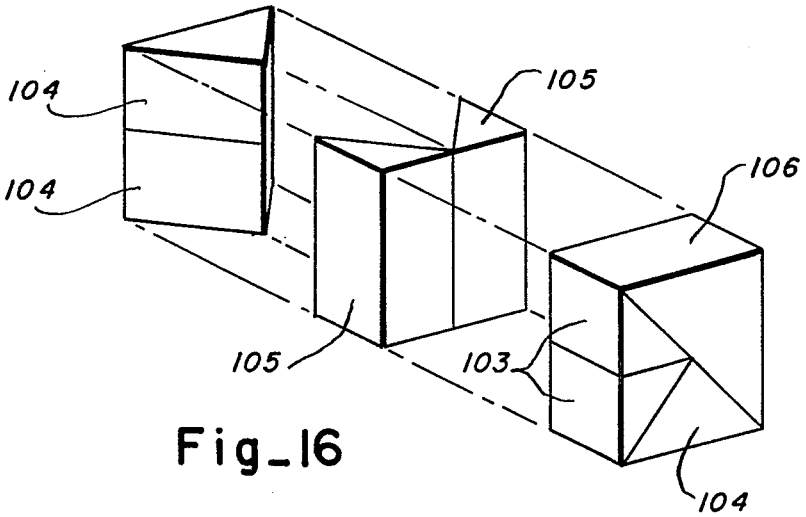

Referring to FIG. 16, another construction of the puzzle cube is shown as comprising: two blocks 103 each consisting of one modular unit having the configuration of an isosceles right triangular prism having a depth A as shown in FIG. 1, three blocks 104 each consisting of two modular units having the configuration of an isosceles right triangular prism having a depth A as shown in FIG. 3, two blocks 105 each consisting of two modular units having the configuration of an isosceles right triangular prism with a depth 2A as shown in FIG. 5, and one block 106 comprising four modular units having the configuration of an isosceles right triangular prism with a depth A as shown in FIG. 6.

The group of blocks may either be viewed as an educational device for the study of solid geometric forms or as a playset or puzzle for the amusement of children or adults. In the educational realm a great deal can be learned about the construction of a variety of geometric polygons, both regular and irregular, created by the interrelationship of the blocks. The blocks may be related to history, mathematics, architecture, sculpture and geometry as well as providing a physical aid to enhance spatial visualization.

Having thus described the invention, various alterations and modifications thereof will occur to those skilled in the art; for example, other combinations of selected ones of the polyhedra of FIGS. 1 through 9 may be combined to form a cube. Such modifications are intended to be within the scope of the invention as defined by the appended claims.

We claim:

1. An amusement device comprising a solid cube which may be disassembled into a plurality of blocks, a plurality of differing geometric shapes selected from the group consisting of only isosceles right triangular prisms, cubes, rhomboid prisms, and rectangular prisms comprising said blocks;

a modular unit comprising an isosceles right triangular prism havng a triangular face formed by two legs each of which has a length A and which meet at a right angle, and a hypoteneuse which has a length B, said modular unit having a depth which is equal to A, and a volume which is equal to C, wherein each of said differing geometric shapes is formed from one or more modular units and has a volume equal to an integral number times C; and wherein said plurality of differing geometric shapes comprise, (a) four isosceles right triangular prisms each having a volume C;

(b) two cubes each having a volume 2C;

(c) two isosceles right triangular prisms each having a volume 2C; and (d) two rhomboids each having a volume 2C, whereby the total volume of said solid cube is equal to 16C.

2. An amusement device comprising a solid cube which may be disassembled into a plurality of blocks, a plurality of differing geometric shapes selected from the group consisting of only isosceles right triangular prisms, cubes, rhomboid prisms, and rectangular prisms comprising said blocks;

a modular unit comprising an isosceles right triangular prism havng a triangular face formed by two legs each of which has a length A and which meet at a right angle, and a hypoteneuse which has a length B, said modular unit having a depth which is equal to A, and a volume which is equal to C, wherein each of said differing geometric shapes is formed from one or more modular units and has a volume equal to an integral number times C; and wherein said plurality of differing geometric shapes comprise, (a) two isosceles right triangular prisms each having a volume 2C;

(b) one rectangular prism having a volume 4C;

(c) one isosceles right triangular prism having a volume 4C; and (d) one rhomboid prism having a volume 4C, wherein the total volume of said cube is equal to 16C.

3. An amusement device comprising a solid cube which may be disassembled into a plurality of blocks, a plurality of differing geometric shapes selected from the group consisting of only isosceles right triangular prisms, cubes, rhomboid prisms, and rectangular prisms comprising said blocks;

a modular unit comprising an isosceles right triangular prism having a triangular face formed by two legs each of which has a length A and which meet at a right angle, and a hypoteneuse which has a length B, said modular unit having a depth which is equal to A, and a volume which is equal to C, wherein each of said differing geometric shapes is formed from one or more modular units and has a volume equal to an integral number times C; and wherein said plurality of differing geometric shapes comprise, (a) two cubes each having a volume 2C;

(b) two isosceles right triangular prisms each having a depth A and a volume 2C;

(c) two rhomboids each having a volume 2C; and (d) two isosceles right triangular prisms each having a depth 2A and a volume 2C, whereby the total volume of said cube is equal to 16C.

4. An amusement device comprising a solid cube which may be disassembled into a plurality of blocks, a plurality of differing geometric shapes selected from the group consisting of only isosceles right triangular prisms, cubes, rhomboid prisms, and rectangular prisms comprising said blocks;

a modular unit comprising an isosceles right triangular prism having a triangular face formed by two legs each of which has a length A and which meet at a right angle, and a hypoteneuse which has a length B, said modular unit having a depth which is equal to A, and a volume which is equal to C, wherein each of said differing geometric shapes is formed from one or more modular units and has a volume equal to an integral number times C; and wherein said plurality of differing geometric shapes comprise, (a) two cubes each having a volume 2C;

(b) two isosceles right triangular prisms each having a depth A and a volume 2C;

(c) two isosceles right triangular prisms each having a depth 2A and a volume 2C; and (d) one isosceles right triangular prism having a volume 4C, whereby the total volume of said cube is equal to 16C.

5. An amusement device comprising a solid cube which may be disassembled into a plurality of blocks, a plurality of differing geometric shapes selected from the group consisting of only isosceles right triangular prisms, cubes, rhomboid prisms, and rectangular prisms comprising said blocks;

a modular unit comprising an isosceles right triangular prism having a triangular face formed by two legs each of which has a length A and which meet at a right angle, and a hypoteneuse which has a length B, said modular unit having a depth which is equal to A, and a volume which is equal to C, wherein each of said differing geometric shapes is formed from one or more modular units and has a volume equal to an integral number times C; and wherein said plurality of differing geometric shapes comprise, (a) two isosceles right triangular prisms each having a volume C;

(b) one cube having a volume 2C;

(c) one isosceles right triangular prism having a depth A and a volume 2C;

(d) one isosceles right triangular prism having a depth 2A and a volume 2C; and (e) two isosceles right triangular prisms each having a volume 4C, whereby the total volume of said cube is equal to 16C.

6. An amusement device comprising a solid cube which may be disassembled into a plurality of blocks, a plurality of differing geometric shapes selected from the group consisting of only isosceles right triangular prisms, cubes, rhomboid prisms, and rectangular prisms comprising said blocks;

a modular unit comprising an isosceles right triangular prism having a triangular face formed by two legs each of which has a length A and which meet at a right angle, and a hypoteneuse which has a length B, said modular unit having a depth which is equal to A, and a volume which is equal to C, wherein each of said differing geometric shapes is formed from one or more modular units and has a volume equal to an integral number times C; and wherein said plurality of differing geometric shapes comprise, (a) two isosceles right triangular prisms each having a volume C;

(b) one cube having a volume 2C;

(c) one isosceles right triangular prism having a depth A and a volume 2C;

(d) one rhomboid having a volume 2C; and (e) two isosceles right triangular prisms each having a volume 4C, whereby the total volume of said cube is equal to 16C.

7. An amusement device comprising a solid cube which may be disassembled into a plurality of blocks, a plurality of differing geometric shapes selected from the group consisting of only isosceles right triangular prisms, cubes, rhomboid prisms, and rectangular prisms comprising said blocks;

a modular unit comprising an isosceles right triangular prism having a triangular face formed by two legs each of which has a length A and which meet at a right angle, and a hypoteneuse which has a length B, said modular unit having a depth which is equal to A, and a volume which is equal to C, wherein each of said differing geometric shapes is formed from one or more modular units and has a volume equal to an integral number times C; and wherein said plurality of differing geometric shapes comprise, (a) two isosceles right triangular prisms each having a volume C;

(b) three isosceles right triangular prisms each having a depth A and a volume 2C;

(c).two isosceles right triangular prisms each having a depth 2A and a volume 2C; and (d) one isosceles right triangular prism having a volume 4C, whereby the total volume of said cube is equal to 16C.

* * * * *